US011497373B2

(12) United States Patent
Hörmann et al.

(10) Patent No.: US 11,497,373 B2
(45) Date of Patent: Nov. 15, 2022

(54) DISHWASHER AND METHOD FOR OPERATING A DISHWASHER

(71) Applicant: BSH Hausgeräte GmbH, Munich (DE)

(72) Inventors: Vitus Hörmann, Glött (DE); Michael Georg Rosenbauer, Reimlingen (DE); Karlheinz Rehm, Dischingen (DE); Johannes Wölfle, Villenbach (DE); Andreas Heidel, Holzheim (DE); Bernd Kränzle, Dischingen (DE)

(73) Assignee: BSH Hausgeräte GmbH, Munich (DE)

( * ) Notice: Subject to any disclaimer, the term of this patent is extended or adjusted under 35 U.S.C. 154(b) by 344 days.

(21) Appl. No.: 16/636,651

(22) PCT Filed: Sep. 11, 2018

(86) PCT No.: PCT/EP2018/074421
§ 371 (c)(1),
(2) Date: Feb. 5, 2020

(87) PCT Pub. No.: WO2019/057545
PCT Pub. Date: Mar. 28, 2019

(65) Prior Publication Data

US 2021/0145242 A1 May 20, 2021

(30) Foreign Application Priority Data

Sep. 25, 2017 (DE) ..... 10 2017 216 947.8

(51) Int. Cl.
*A47L 15/00* (2006.01)
*A47L 15/42* (2006.01)
*A47L 15/50* (2006.01)

(52) U.S. Cl.
CPC ..... *A47L 15/0049* (2013.01); *A47L 15/4221* (2013.01); *A47L 15/4225* (2013.01);
(Continued)

(58) Field of Classification Search
CPC ..... A47L 15/0049; A47L 15/4221; A47L 15/4293; A47L 15/4225; A47L 15/508;
(Continued)

(56) References Cited

U.S. PATENT DOCUMENTS

2005/0133070 A1* 6/2005 Vanderroest ..... A47L 15/4221 134/99.1
2006/0219262 A1* 10/2006 Peterson ..... A47L 15/4244 134/25.2

(Continued)

FOREIGN PATENT DOCUMENTS

DE 19630357 A1 * 2/1998 ..... A47L 15/4244
DE 19630357 A1 2/1998
DE 102012101537 A1 * 8/2013 ..... A47L 15/0063

OTHER PUBLICATIONS

Machine translation of DE19630357A1 (Year: 1998).*
Machine translation of DE102012101537A1 (Year: 2013).*
National Search Report DE 10 2017 216 947.8 dated Jun. 22, 2018.
International Search Report PCT/EP2018/074421 dated Nov. 21, 2018.

*Primary Examiner* — Douglas Lee
(74) *Attorney, Agent, or Firm* — Michael E. Tschupp; Andre Pallapies; Brandon G. Braun

(57) ABSTRACT

A dishwasher includes a pump device operated by a pump current for supply of washing liquor to a first spray device via a first hydraulic arrangement for providing a first washing zone and to a second spray device via a second hydraulic arrangement for providing a second washing zone. A third spray device is connected to one of the first and second hydraulic arrangements for providing an intensive washing zone. In a first switching state, the third spray device is isolated from the one hydraulic arrangement, and in a second switching state the third spray device is connected to the one hydraulic arrangement. A control device determines a current switching state of the third spray device as a function of a difference between the pump current when washing liquor is supplied to the first hydraulic arrangement and when
(Continued)

washing liquor is supplied to the second hydraulic arrangement.

14 Claims, 4 Drawing Sheets

(52) U.S. Cl.
CPC ..... *A47L 15/4293* (2013.01); *A47L 15/508* (2013.01); *A47L 2401/08* (2013.01); *A47L 2501/265* (2013.01)

(58) Field of Classification Search
CPC ..... A47L 15/0007; A47L 2401/08; A47L 2401/30; A47L 2501/03; A47L 2501/265
See application file for complete search history.

(56) References Cited

U.S. PATENT DOCUMENTS

| | | | | |
|---|---|---|---|---|
| 2010/0121497 | A1 | 5/2010 | Heisele et al. | |
| 2011/0126863 | A1 | 6/2011 | Kraenzle et al. | |
| 2015/0250374 | A1 | 9/2015 | McDaniel et al. | |
| 2015/0305592 | A1* | 10/2015 | Pers | A47L 15/4289 134/113 |
| 2015/0359405 | A1 | 12/2015 | Kim et al. | |
| 2016/0278608 | A1 | 9/2016 | Edenius et al. | |
| 2017/0105595 | A1* | 4/2017 | Lambert | G06F 3/14 |
| 2018/0310797 | A1 | 11/2018 | Persson | |
| 2019/0174989 | A1* | 6/2019 | Persson | A47L 15/4244 |

* cited by examiner

DISHWASHER AND METHOD FOR OPERATING A DISHWASHER

CROSS-REFERENCES TO RELATED APPLICATIONS

This application is the U.S. National Stage of International Application No. PCT/EP2018/074421, filed Sep. 11, 2018, which designated the United States and has been published as International Publication No. WO 2019/057545 A1 and which claims the priority of German Patent Application, Serial No. 10 2017 216 947.8, filed Sep. 25, 2017, pursuant to 35 U.S.C. 119(a)-(d).

BACKGROUND OF THE INVENTION

The present invention relates to a dishwasher as well as a method for operating a dishwasher.

Dishwashers are known, which have different spray devices, allowing a user for example to switch between the different spray devices manually. One of the spray devices can be configured to provide a special washing zone, which achieves a particularly good cleaning result or is designed for specifically shaped items to be washed. US 2015/0250374 A1 therefore shows a dishwasher, in which a bottle washing facility can be engaged by means of a manually switchable valve. WO 2015/090433 discloses a similar device, with which a special holder for items to be washed, which has integrated spray nozzles, can be supplied with washing liquor, so that on the one hand washing liquor is directed specifically onto the items to be cleaned by means of the integrated spray nozzles and on the other hand the items being washed are held securely by the holder during a washing cycle.

The switching position of such additional spray facilities can impact on the cleaning result of the dishwasher, for example if there is not sufficient washing liquor in the washing circuit to supply all the spray facilities with washing liquor or because the liquid pressure of the washing liquor is too low. It is therefore advantageous for the switching position of the additional spray facility to be known so that it is possible to respond appropriately to this. It is complex and expensive however to arrange a corresponding sensor in the washing compartment of such a dishwasher. Also such a sensor would be error-prone due to conditions in the washing compartment.

DE 10 2007 017 274 A1 describes a method for detecting the position of a closing element in a water switch of a dishwasher. A signal value is acquired from the circulating pump and compared with a stored signal value, which corresponds to a reference position of the closing element. This makes it possible to detect when the closing element is in the reference position. WO 2014/071980 A1 discloses a method for detecting the switching position of an additional spray facility based on the measurement of a pump current at different circulating pump speeds.

BRIEF SUMMARY OF THE INVENTION

Against this background one object of the invention is to provide an improved dishwasher.

According to a first aspect a dishwasher, in particular a household dishwasher, is proposed, with a first spray device, assigned to a first hydraulic arrangement, for providing a first washing zone, a second spray device, assigned to a second hydraulic arrangement, for providing a second washing zone, it being possible for washing liquor to be supplied to the first hydraulic arrangement and the second hydraulic arrangement by a pump device that can be operated by means of a pump current, and a third spray device for providing an intensive washing zone, which is assigned to the first hydraulic arrangement or the second hydraulic arrangement. The third spray device has a first switching state and a second switching state, the third spray device being isolated from the assigned hydraulic arrangement in the first switching state and being connected to the assigned hydraulic arrangement in the second switching state. The dishwasher also has a control device, which is designed to determine a current switching state of the third spray device as a function of a difference between the pump current when washing liquor is supplied to the first hydraulic arrangement and when washing liquor is supplied to the second hydraulic arrangement.

Such a dishwasher has the advantage that it is possible to determine the current switching state of the third spray device in a reliable and self-calibrated manner without additional parts. It is thus possible to perform an additional function, which makes operation of the dishwasher more reliable, using parts that are already present.

Reference is simply made in the following to determining or determination rather than to determining the switching state of the third spray device.

The dishwasher for example has a washing chamber with receptacles for items to be washed arranged therein, it being possible for the washing chamber to be closed by means of a door and to form a washing compartment in the closed state. The dishwasher can have one or more receptacles for items to be washed, for example an upper rack and a lower rack. The dishwasher has at least one first spray device and a second spray device, each of which is designed to provide a washing zone in the washing compartment. For example the first spray device is arranged near the lower rack, the first washing zone comprising the lower rack. The second spray device is assigned to the upper rack for example, the second washing zone comprising the upper rack.

Washing liquor can be supplied to the spray devices by means of the respective hydraulic arrangement assigned to them. A hydraulic arrangement in particular comprises pipes, valves, connectors and different further elements, which are designed to conduct a fluid, in particular the washing liquor. The hydraulic arrangements can be supplied with washing liquor by a pump device, in particular a circulating pump and/or a drain pump. To this end a water switch is arranged for example at an outlet of the pump device, where the pump device outputs or supplies the washing liquor with an overpressure. The water switch has at least two positions, for example supplying the washing liquor to the first hydraulic arrangement in a first position and supplying the washing liquor to the second hydraulic arrangement in a second position. This allows the two hydraulic arrangements to be supplied with washing liquor in an alternating manner. Provision can also be made for a third position of the water switch, in which both hydraulic arrangements are supplied with washing liquor at the same time, it being possible to select the ratio of the quantity of washing liquor supplied to the first hydraulic arrangement to the quantity of washing liquor supplied to the second hydraulic arrangement freely.

The respective hydraulic arrangement preferably runs outside the washing chamber but can also run partly inside the washing chamber.

The third spray device is assigned for example to the second spray device and is designed to provide an intensive washing zone. The intensive washing zone for example comprises a predetermined region in the upper rack. The location and/or arrangement of the intensive washing zone is a function in particular of the arrangement and/or configuration of the third spray device. For example the third spray device is assigned to the second hydraulic arrangement and can therefore be supplied with washing liquor by means of the second hydraulic arrangement.

It is a function in particular of the switching state of the third spray device whether or not the intensive washing zone is provided when the second hydraulic arrangement is supplied with washing liquor. Provision of a washing zone here means for example that during operation of the dishwasher a spray device sprays the washing liquor in the region of the washing zone, in particular with an overpressure, when said washing liquor is supplied to the hydraulic arrangement to which the spray device is assigned. The overpressure here is a function in particular of a pump speed and different characteristic properties of the respective hydraulic arrangement and/or the spray device.

The switching state of the third spray device can be set for example by means of a valve. The valve is configured for example as a switching valve, which has an "open" switching position and a "closed" switching position. In the "open" switching position the third spray device is connected to the hydraulic arrangement, in other words the valve allows washing liquor to pass from the hydraulic arrangement to the third spray device. In the "closed" switching position the third spray device is isolated from the hydraulic arrangement, in other words the valve blocks the washing liquor so no washing liquor can pass to the third spray device.

The dishwasher also has a control device, which can be implemented by means of hardware and/or software. In the case of a hardware implementation the control device can be configured as a computer or microprocessor for example. In the case of a software implementation the control device can be configured as a computer program product, a function, a routine, part of a program code or as an executable object.

The control device is designed in particular to detect the pump current, with which the pump device is operated. Detection of the pump current means for example that the control device measures or reads out the current supplied to the pump device or consumed by it and stores the corresponding current value in a memory. The control device here can detect and store for example a plurality of current values at different times, in particular periodically.

The pump device is operated for example at a predefined pump speed. The pump speed can be set for example by means of a terminal voltage of the pump device. A washing liquor overpressure can be increased for example by increasing the pump speed. The pump current provided by a corresponding voltage source changes as a function of an electric power required to provide the pump speed. In particular a volumetric flow of the washing liquor to be conveyed correlates positively with the required pump current. In other words a higher volumetric flow requires a larger pump current at a predefined speed. The volumetric flow is a function for example of a counterpressure, which is a function for example of a pipe diameter of the hydraulic arrangement supplied with the washing liquor and/or an outlet cross section of the spray device. In particular the volumetric flow increases when the third spray device is connected to a respective hydraulic arrangement, as this provides an additional path out of the hydraulic arrangement for the washing liquor and therefore an effectively larger outlet cross section.

For example a first pump current is required to supply the first hydraulic arrangement and a second pump current is required when supplying the second hydraulic arrangement. The pump current required is a function of known parameters here, for example the design of the respective hydraulic arrangements or assigned spray devices, but can also change over time, for example from washing operation to washing operation or even within the performance of one washing operation, for example due to variable parameters, such as sluggishness of the pump device and/or a problem with the loading of items to be washed in the dishwasher. Thus an absolute pump current can vary over time even with constant operating parameters, so it is not possible to conclude one or more operating parameters reliably from the absolute pump current.

Operating parameters include in particular a switching position of a water switch, the pump speed and a switching state of the third spray device.

The third spray device is assigned to the second hydraulic arrangement for example. When washing liquor is supplied to the second hydraulic arrangement, the pump current is greater if the third spray device is connected to the second hydraulic arrangement than if the third spray device is isolated from the second hydraulic arrangement. In order to ascertain this difference in pump current clearly and reliably, the control device is designed to detect the pump current when the first hydraulic arrangement is supplied and the pump current when the second hydraulic arrangement is supplied and to compare the two detected values and to determine the current switching state of the third spray device therefrom. This means that parameters or conditions that vary over time and impact on the pump current are not taken into account, as the impact on the pump current is the same or at least essentially the same for both detection operations, if the respective pump currents are detected at roughly similar times. For example the two detection operations are within a predetermined time interval. In particular the two detection operations take place one immediately after the other, for example around the time of switching from the first hydraulic arrangement to the second hydraulic arrangement.

Comparing means for example differentiating. Because the current switching state of the third spray device is determined as a function of such a difference in pump current, it ensures that any fluctuation over time of the absolute pump current does not result in an incorrect determination result. It can therefore be said that the current switching state of the third spray device is determined in a self-consistent manner or automatic standardization or calibration takes place with each determination. It is therefore not necessary to undertake a corresponding manual calibration with the proposed dishwasher.

According to one embodiment of the dishwasher the control device is designed to detect a first pump current when the first hydraulic arrangement is supplied with washing liquor, a second pump current when the second hydraulic arrangement is supplied with washing liquor and to determine a delta value as a difference between the first pump current and the second pump current, to determine the current switching state of the third spray device.

According to a further embodiment of the dishwasher the control device is designed to compare the determined delta value with a predefined threshold value, to determine the current switching state of the third spray device, the delta value being greater than the threshold value in the first switching state of the third spray device and smaller than the threshold value in the second switching state of the third spray device.

Converse logic is also possible, in other words the delta value is smaller than the threshold value in the first switching state of the third spray device and greater than the threshold value in the second switching state of the third spray device.

According to a further embodiment of the dishwasher the control device is designed to detect a first temporal mean value of the first pump current when the first hydraulic arrangement is supplied during a first predetermined time interval, to detect a second temporal mean value of the second pump current when the second hydraulic arrangement is supplied during a second predetermined time interval and to determine the delta value as a difference between the first temporal mean value and the second temporal mean value, to determine the current switching state of the third spray device.

Because the pump current is detected as a temporal mean value in each instance, it is not possible for small, temporally very short fluctuations of the pump current to bring about an incorrect determination result. For example it may be that air bubbles in the washing liquor are taken in by the pump device and impact on the pump current within fractions of a second. The first predetermined time interval and the second predetermined time interval can be of equal length or of different length. A predetermined time interval can in particular be in the region of up to 30 seconds.

According to a further embodiment provision can be made for a predetermined time interval to be selected from a plurality of predetermined time intervals as a function of a current pump current variance. Variance refers for example to a pump current fluctuation around a temporal pump current average. The temporal average relates for example to a time interval that includes at least the part of the predetermined time interval that has already elapsed.

According to a further embodiment of the dishwasher the control device is designed to perform one dishwashing program from a number of dishwashing programs, each of the dishwashing programs being determined by dishwashing program parameters, the control device also being designed to adjust the dishwashing program parameters for a dishwashing program currently being performed as a function of the current switching state of the third spray device and as a function of the dishwashing program currently being performed.

In this embodiment it is advantageously ensured that the dishwashing program parameters of the dishwashing program currently being performed are adjusted so that a predefined cleaning result is achieved.

For example the adjustment comprises increasing the volume of washing liquor when the third spray device is in the second switching state and/or increasing the pump speed. Further dishwashing program parameters include washing liquor temperature, duration of sub-steps of the dishwashing program and dosing time for cleaning agents and/or rinse aid.

According to a further embodiment of the dishwasher the control device is designed to determine the current switching state of the third spray device at the start of each performance of the dishwashing program.

Because the determination takes place right at the start, the dishwashing program parameters can be adjusted from the start so the dishwashing program can then proceed without further adjustment.

At the start of each performance means for example that the determination is performed as a first program sub-step. Alternatively or additionally the determination can take place every time a switch is made from the first hydraulic arrangement to the second hydraulic arrangement as part of the dishwashing program being performed. Provision can also be made for the determination to be performed every time a user of the dishwasher opens the door of the dishwasher briefly during the performance of the dishwashing program. This advantageously ensures that switching of the switching state by the user is reliably determined during the performance of a dishwashing program.

According to a further embodiment of the dishwasher the pump speed of the pump device is constant during the determination of the current switching state of the third spray device.

A variable pump speed would result in a variable pump current, meaning that a determination in such an instance would not be reliable, which is hereby excluded.

According to a further embodiment of the dishwasher the control device is designed also to monitor the smooth running of the pump device when determining the current switching state of the third spray device.

Smooth running of the pump can be impaired for example if there is too little washing liquor, as the pump device then takes in air for example. Smooth running means in particular that terminal voltage and pump current are constant or essentially constant over time. This is also referred to as smooth running detection.

Determination of the switching state of the third spray device can in particular be terminated or interrupted if the pump device is not running smoothly.

According to a further embodiment of the dishwasher the third spray device can be switched manually from the first switching state to the second switching state and/or manually from the second switching state to the first switching state by means of a switching device.

According to a further embodiment of the dishwasher the switching device comprises a valve, in particular a switching valve.

According to a further embodiment of the dishwasher the first spray device comprises a first spray arm and the second spray device comprises a second spray arm.

According to a further embodiment of the dishwasher the third spray device comprises a third spray arm and/or at least one spray nozzle.

Such a spray nozzle can be incorporated for example in a side wall of the washing container.

According to a further embodiment of the dishwasher it has an output unit, which is designed to output the current switching state of the third spray device to a user.

This has the advantage that the user can respond immediately to the current switching state, for example by changing the switching state accordingly, having forgotten to do so at the start of the dishwashing program.

The output unit is configured in particular as a display or indicator. The output unit can also be configured as a single lighting means, such as a light bulb or an LED.

According to a further embodiment of the dishwasher the output unit is designed to transmit the current switching state to a mobile device of the user.

The mobile device is in particular a smartphone of the user, on which a corresponding app is installed. The app is designed to receive the current switching state and optionally one or more operating parameters of the dishwasher from the output unit and display them for the user. Provision can also be made for the user to control specific remotely controllable functions of the dishwasher, for example selection of a dishwashing program to be performed, by means of the mobile device.

According to a second aspect a method for operating a dishwasher, in particular a household dishwasher, is proposed. The dishwasher comprises a first spray device, assigned to a first hydraulic arrangement, for providing a first washing zone, a second spray device, assigned to a second hydraulic arrangement, for providing a second washing zone, it being possible for washing liquor to be supplied to the first hydraulic arrangement and the second hydraulic arrangement by a pump device that can be operated by means of a pump current, and a third spray device for providing an intensive washing zone, which is assigned to the first hydraulic arrangement or the second hydraulic arrangement. The third spray device has a first switching state and a second switching state, the third spray device being isolated from the assigned hydraulic arrangement in the first switching state and being connected to the assigned hydraulic arrangement in the second switching state. According to the method a current switching state of the third spray device is determined by a control device as a function of a difference between the pump current when washing liquor is supplied to the first hydraulic arrangement and when washing liquor is supplied to the second hydraulic arrangement.

Determination of the switching state can be considered to be for example a method divided into a number of method sub-steps. According to a first method sub-step the control device detects a first pump current while the first hydraulic arrangement is supplied with washing liquor. In a second method sub-step for example a water switch is repositioned so the second hydraulic arrangement is now supplied with washing liquor. According to a third method sub-step the control device detects a second pump current while the second hydraulic arrangement is supplied with washing liquor. In a fourth method sub-step the control device determines a difference between the first pump current and the second pump current. In a fifth method sub-step the control device compares the determined difference for example with a predefined threshold value and determines the current switching state of the third spray device therefrom.

A computer program product is also proposed, which initiates the performance of the method set out above on a program-controlled facility.

A computer program product, for example a computer program means, can be provided or supplied in the form of a storage medium, for example a memory card, USB stick, CD-ROM, DVD, or as a file that can be downloaded from a server in a network. This can take place for example in a wireless communication network by transferring a corresponding file containing the computer program product or the computer program means.

The embodiments and features described for the proposed dishwasher apply correspondingly to the proposed method.

Further possible implementations of the invention comprise combinations of features or embodiments described above or in the following with regard to the exemplary embodiments even if these are not cited specifically. The person skilled in the art will also add individual aspects to improve or complete the respective basic form of the invention.

BRIEF DESCRIPTION OF THE DRAWINGS

Further advantageous configurations and aspects of the invention are set out in the subclaims and the exemplary embodiments of the invention described in the following. The invention is also described in more detail based on preferred embodiments with reference to the accompanying figures.

DETAILED DESCRIPTION OF EXEMPLARY EMBODIMENTS OF THE PRESENT INVENTION

Figure 1:
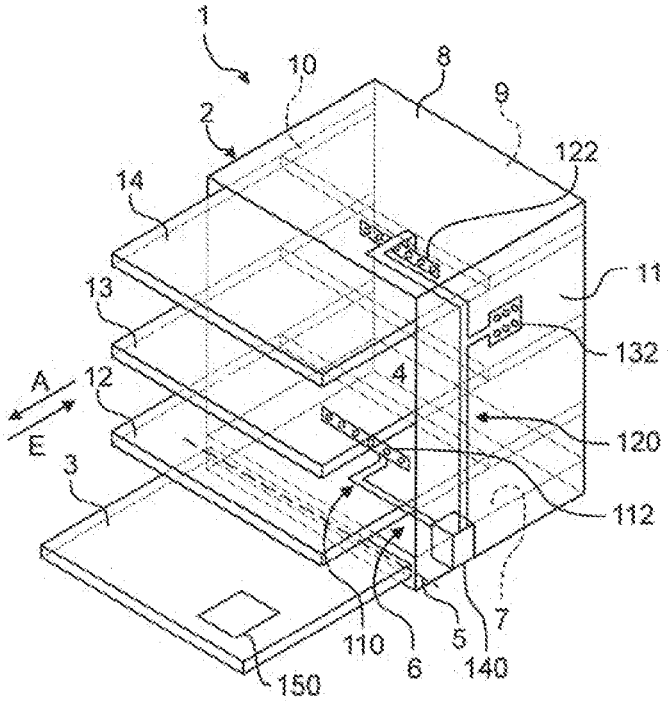
FIG. 1 shows a schematic perspective view of an exemplary embodiment of a dishwasher.

Identical elements or those of identical function are shown with the same reference characters in the figures, unless otherwise specified.

FIG. 1 shows a schematic perspective view of an embodiment of a dishwasher 1. The dishwasher 1 is configured as a household dishwasher 1 here. The household dishwasher 1 comprises a washing container 2, which can be closed, in particular in a water-tight manner, by a door 3. To this end a sealing facility (not shown) can be provided between the door 3 and the washing container 2. The washing container 2 is preferably box-shaped. The washing container 2 can be arranged in a housing of the household dishwasher 1. The washing container 2 and door 3 can form a washing chamber 4 for washing items to be washed.

The door 3 is shown in its opened position in FIG. 1. The door 3 can be closed or opened by pivoting about a pivot axis 5 provided at a lower end of the door 3. A loading opening 6 of the washing container 2 can be closed or opened with the aid of the door 3. The washing container 2 has a base 7, a top 8 arranged opposite the base 7, a rear wall 9 arranged opposite the closed door 3 and two opposing side walls 10, 11. The base 7, top 8, rear wall 9 and side walls 10, 11 can be made of stainless steel sheet for example. Alternatively the base 7 for example can be made of a plastic material.

The household dishwasher 1 also has at least one receptacle 12, 13, 14 for items to be washed. A number of receptacles 12, 13, 14 for items to be washed, for example three, can preferably be provided, it being possible for the receptacle 12 for items to be washed to be a lower receptacle for items to be washed or a lower rack, the receptacle 13 for items to be washed to be an upper receptacle for items to be washed or an upper rack and the receptacle 14 for items to be washed to be a flatware drawer. As also shown in FIG. 1, the receptacles 12, 13, 14 for items to be washed are arranged one above the other in the washing container 2. Each receptacle 12 to 14 for items to be washed can be moved into or out of the washing container 2 as required. In particular each receptacle 12, 13, 14 for items to be washed can be pushed into the washing container 2 in an insertion direction E and pulled out of the washing container 2 in a pull-out direction A counter to the insertion direction E.

The household dishwasher 1 also has a first spray device 112 assigned to a first hydraulic arrangement 110 and configured as a spray arm, a second spray device 122 assigned to a second hydraulic arrangement 120 and also configured as a spray arm and a third spray device 132 assigned to the second hydraulic arrangement. The first spray arm 112 is arranged on the base 7 of the washing container 2, the second spray arm 122 is arranged on the top 8 of the washing container 2 and the third spray device 132, which is configured as a number of spray nozzles, is arranged on the side wall 9 of the washing container 2. The first hydraulic arrangement 110 and the second hydraulic arrangement 120 can be supplied with washing liquor by means of a pump device 140 during operation of the household dishwasher 1. A control device 150 arranged on the door 3 of the household dishwasher 1 is also shown.

The control device 150 is designed in particular to detect a pump current 142 (see FIG. 3) for operating the pump device 140. Because the control device 150 detects and compares the pump current 142 when the first hydraulic arrangement 110 is supplied with washing liquor and when the second hydraulic arrangement 120 is supplied with washing liquor, the control device 150 can determine the current switching state of the third spray device 132.

Figure 2:
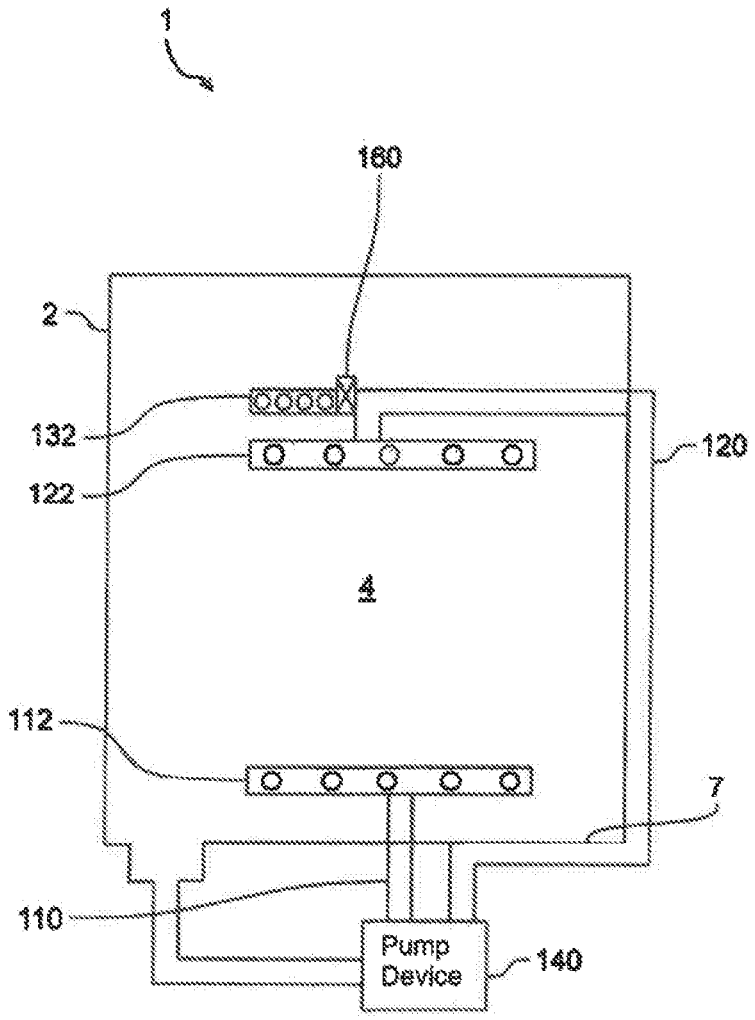
FIG. 2 shows a schematic view of a further exemplary embodiment of a dishwasher.

FIG. 2 shows a schematic view of a further exemplary embodiment of a dishwasher 1, which is also configured as a household dishwasher. The household dishwasher 1 for example has the same features as the exemplary embodiment illustrated in FIG. 1 but with many of the features not shown for greater clarity. The pump device 140 is now arranged below the base 7 of the washing container 2, the base 7 having a drain for the washing liquor, which is designed to supply the washing liquor to the pump device 140. The third spray device 132 here is configured as a third spray arm and assigned to the second hydraulic arrangement 120. A switching device 160, configured here as a manually switchable valve, is also arranged at the connection between the third spray arm 132 and the second hydraulic arrangement 120. The manually switchable valve 160 has an opened state and a closed state.

When the valve 160 is in the closed state, the third spray arm 132 is isolated from the second hydraulic arrangement 120, in other words the third spray arm 132 is in the first switching state. When the third spray arm 132 is in the first switching state and the second hydraulic arrangement 120 is supplied with washing liquor by the pump device 140, the washing liquor only passes to the second spray arm 122 and only the second washing zone is provided. A first volumetric flow of washing liquor results as a function of a pump speed of the pump device 140.

When the valve 160 is in the opened state, the third spray arm 132 is connected to the second hydraulic arrangement 120, in other words the third spray arm 132 is in the second switching state. When the third spray arm 132 is in the second switching state and the second hydraulic arrangement 120 is supplied with washing liquor by the pump device 140, the washing liquor passes to the second spray arm 122 and to the third spray arm 132, providing both the second washing zone and the intensive washing zone. A second volumetric flow of washing liquor results as a function of the pump speed.

If the pump speed is the same in both switching states of the third spray arm 132, the second volumetric flow is greater than the first volumetric flow. The greater volumetric flow requires a higher consumption of electrical energy. As the terminal voltage of the pump device 140 is constant or essentially constant when the pump speed is constant, the greater electrical energy is supplied by an increased pump current 142 (see FIG. 3). It is therefore possible to conclude the current switching state of the third spray device 132 from the pump current 142.

In order to exclude error sources, which can result in an increased pump current 142, for example sluggishness of the pump device 140, a manner of calibration is performed on the pump current 142. To this end the pump current 142 required to supply the hydraulic arrangement 110, 120, to which the third spray device 132 is not assigned, is detected as the reference pump current. In the present exemplary embodiment this is the first hydraulic arrangement 110. The reference pump current is detected again every time the current switching state of the third spray device 132 is determined.

The third spray device can alternatively also be assigned to the first hydraulic arrangement 110 (not shown). The pump current 142 required to supply the second hydraulic arrangement 120 is then detected as the reference pump current.

Figure 3:
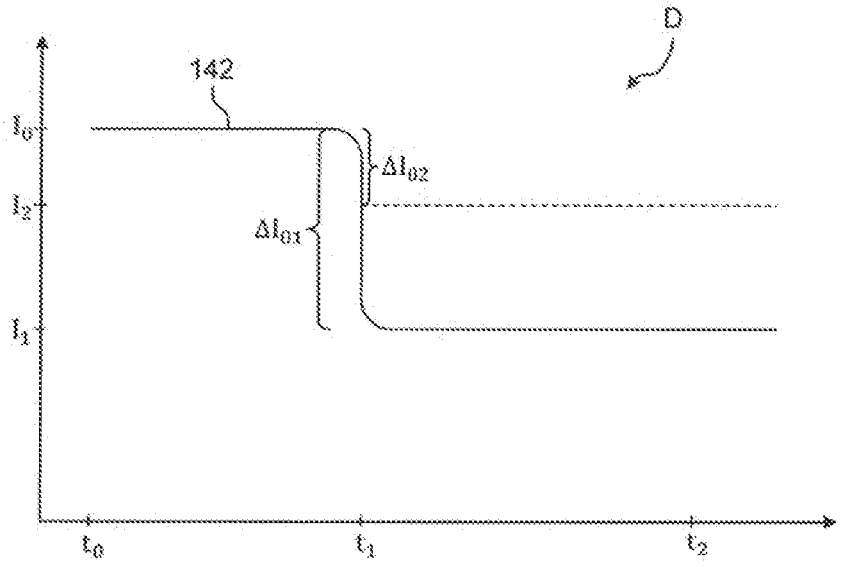
FIG. 3 shows an exemplary diagram of a profile of a pump current.

FIG. 3 shows a schematic exemplary diagram D of a pump current 142 over a time period from a start time to $t_0$ an end time $t_2$. The illustrated pump current 142 is detected for example during operation of a household dishwasher 1 in FIG. 1 or FIG. 2. At a switching time $t_1$, which is between the start time to and the end time $t_2$, a water switch for example is repositioned, so that washing liquor is supplied to the second hydraulic arrangement 120 instead of the first hydraulic arrangement 110. In other words during the period $t_0$-$t_1$ washing liquor is supplied to the first hydraulic arrangement 110 and during the period $t_1$-$t_2$ washing liquor is supplied to the second hydraulic arrangement 120.

The pump current 142 is shown on the y-axis of the diagram D. Three values $I_0$, $I_1$ and $I_2$ in particular are marked. In this example $I_0$ for example corresponds to the pump current 142 required to supply the first hydraulic arrangement 110 with washing liquor. This pump current 142 can also be referred to as the first pump current $I_0$. $I_1$ for example corresponds to the pump current 142 required to supply the second hydraulic arrangement 120, when the third switching device 132 is in the first switching state, in other words isolated from the second hydraulic arrangement 120. $I_2$ for example corresponds to the pump current 142 required to supply the second hydraulic arrangement 120, when the third switching device 132 is in the second switching state, in other words connected to the second hydraulic arrangement 120. $I_1$ and $I_2$ can also be referred to as the second pump current.

Diagram D shows how the pump current 142 changes at switching time $t_1$, when the switch is made from the first hydraulic arrangement 110 to the second hydraulic arrangement 120. It shows both possibilities in respect of the current switching state of the third spray device 132, the continuous line showing the pump current 142 in the first switching state and the broken line showing the pump current 142 in the second switching state. It can be seen that the pump current 142 is different in the two switching states. The difference $\Delta I_{01}$, $\Delta I_{02}$ is also shown for each switching state. The resulting difference $\Delta I_{01}$, $\Delta I_{02}$ is greater, the faster the pump speed of the pump device 140. In this sense it can be advantageous to increase the pump speed when determining the current switching state of the third spray device 132.

The control device 150 (see FIG. 1) is designed in particular to determine this difference $\Delta I_{01}$, $\Delta I_{02}$ and to determine the current switching state of the third spray device 132 as a function of the magnitude or size of the difference $\Delta I_{01}$, $\Delta I_{02}$. For example the control device 150 compares the determined difference $\Delta I_{01}$, $\Delta I_{02}$ with a predetermined threshold value for this purpose.

The concept described with reference to FIGS. 1 to 3 can be extended to any number of hydraulic arrangements 110, 120, of which any except one can have an additional, for example manually switchable, spray device assigned to it. It is therefore sufficient for one of the hydraulic arrangements 110, 120 to have a clearly defined and unchangeable state, so that a reference pump current can be detected when said hydraulic arrangement 110, 120 is supplied with washing liquor.

It is also conceivable for a fourth spray device to be assigned for example to the second hydraulic arrangement 120 and to have two switching states like the third spray device 132. The control device 150 is then designed for example to determine, as a function of the difference between the pump current 142 when the first hydraulic arrangement 110 is supplied with washing liquor and when the second hydraulic arrangement 120 is supplied with washing liquor, whether the third spray device 132 or the fourth spray device is in the second switching state or whether the third spray device 132 and the fourth spray device are in the second switching state.

Figure 4:
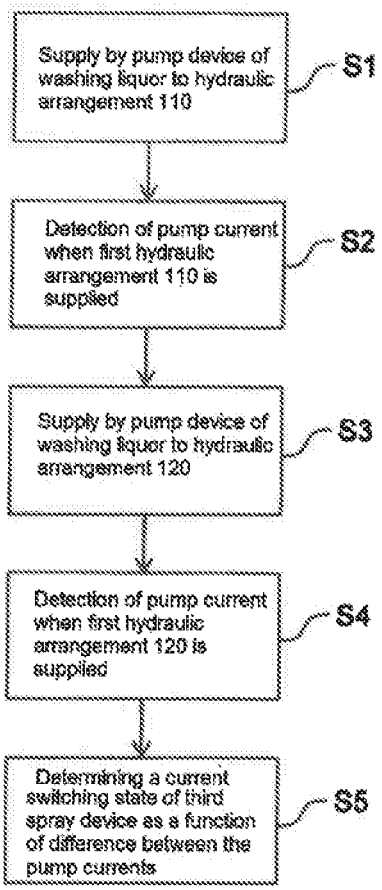
FIG. 4 shows a block diagram of an exemplary method for operating a dishwasher.

FIG. 4 shows a block diagram of an exemplary method for operating a dishwasher 1, for example a household dishwasher according to FIG. 1 or FIG. 2. The exemplary method allows a control device 150 to determine a current switching state of a third spray device 132 as a function of a difference $\Delta I_{01}$, $\Delta I_{02}$ between the pump current 142 when the first hydraulic arrangement 110 is supplied with washing liquor and when the second hydraulic arrangement 120 is supplied with washing liquor.

The method comprises the following method steps S1-S5 for example. In a first method step S1 washing liquor is supplied to the hydraulic arrangement 110. To this end a pump device 140 is operated at a predetermined speed. In a second method step S2, which takes place in particular during the performance of the first method step S1, the control device 150 detects the pump current 142 required to operate the pump device 140 when the first hydraulic arrangement 110 is supplied. The control device 150 in particular detects a first pump current $I_0$. Provision can be made here in particular for the control device 150 to detect the pump current 142 over a predetermined time interval and to detect a temporal mean value of the pump current 142 in this time interval. Provision can also be made for the control device 150 to monitor the smooth running of the pump device 140 while the pump current 142 is detected. In a third method step S3 the second hydraulic arrangement 120 is supplied with washing liquor. During this process the pump device 140 is operated in particular at the same pump speed as in method steps S1 and S2.

In a fourth method step S4, which takes place in particular during the performance of the third method step S3, the control device 150 detects the pump current 142 required to operate the pump device 140 when the second hydraulic arrangement 120 is supplied. The control device 150 in particular detects a second pump current $I_1$, $I_2$. The exemplary embodiments cited for the second method step S2 apply accordingly to the fourth method step S4. In a fifth method step S5 the control device 150 determines the current switching state of the third spray device 132 as a function of the difference $\Delta I_{01}$, $\Delta I_{02}$ between the pump currents 142, in particular the first pump current $I_0$ and the second pump current $I_1$, $I_2$. To this end for example the control device 150 forms a difference between the first pump current $I_0$ and the second pump current $I_1$, $I_2$ and compares the result with a predefined threshold value. The control device 150 can determine the current switching state depending on whether the difference is greater than the threshold value or smaller than the threshold value.

Although the present invention has been described based on exemplary embodiments, it can be modified in many different ways.

The invention claimed is:

1. A household dishwasher, comprising:

a first hydraulic arrangement;

a second hydraulic arrangement;

a pump device operated by a pump current for supply of a washing liquor to the first hydraulic arrangement and to the second hydraulic arrangement;

a first spray device connected to the first hydraulic arrangement for providing a first washing zone;

a second spray device connected to the second hydraulic arrangement for providing a second washing zone;

a third spray device connected to one of the first and second hydraulic arrangements for providing an intensive washing zone, said third spray device having a first switching state in which the third spray device is isolated from the one of the first and second hydraulic arrangements, and a second switching state in which the third spray device is connected to the one of the first and second hydraulic arrangements; and a control device configured to determine a current switching state of the third spray device as a function of a difference between the pump current when washing liquor is supplied to the first hydraulic arrangement and when washing liquor is supplied to the second hydraulic arrangement, the control device configured to determine the current switching state of the third spray device by detecting a first pump current when the first hydraulic arrangement is supplied with washing liquor, detecting a second pump current when the second hydraulic arrangement is supplied with washing liquor, and determining a delta value as a difference between the first pump current and the second pump current, the control device further configured to compare the delta value with a predefined threshold value, with the delta value being greater than the threshold value in the first switching state of the third spray device and smaller than the threshold value in the second switching state of the third spray device.

2. The dishwasher of claim 1, wherein the control device is configured to detect a first temporal mean value of the first pump current when the first hydraulic arrangement is supplied during a first predetermined time interval, to detect a second temporal mean value of the second pump current when the second hydraulic arrangement is supplied during a second predetermined time interval, and to determine the delta value as a difference between the first temporal mean value and the second temporal mean value.

3. The dishwasher of claim 1, wherein the control device is configured to perform a dishwashing program selected from a number of dishwashing programs, each of the dishwashing programs being determined by a plurality of dishwashing program parameters, said control device adjusting at least one dishwashing program parameter from the plurality for the dishwashing program currently being performed as a function of the current switching state of the third spray device and as a function of a dishwashing program currently being performed.

4. The dishwasher of claim 3, wherein the control device determines the current switching state of the third spray device at a start of each performance of the dishwashing program.

5. The dishwasher of claim 1, wherein the pump device operates at a pump speed which is constant during determination of the current switching state of the third spray device.

6. The dishwasher of claim 1, wherein the control device monitors a smooth running of the pump device when determining the current switching state of the third spray device.

7. The dishwasher of claim 1, further comprising a manually operated switching device to switch the third spray device from the first switching state to the second switching state, and vice versa.

8. The dishwasher of claim 7, wherein the switching device comprises a valve.

9. The dishwasher of claim 8, wherein the valve is a switching valve.

10. The dishwasher of claim 1, wherein each of the first and second spray devices comprises a spray arm.

11. The dishwasher of claim 1, wherein the third spray device comprises a spray arm or a spray nozzle or both.

12. The dishwasher of claim 1, further comprising an output unit configured to output the current switching state of the third spray device to a user.

13. The dishwasher of claim 12, wherein the output unit transmits the current switching state to a mobile device of the user.

14. A method for operating a household dishwasher, said method comprising:

operating a pump device by a pump current for supply of washing liquor to a first spray device via a first hydraulic arrangement for providing a first washing zone and for supply of washing liquor to a second spray device via a second hydraulic arrangement for providing a second washing zone;

connecting a third spray device to one of the first and second hydraulic arrangements for providing an intensive washing zone, allowing the third spray device to be switched between a first switching state in which the third spray device is isolated from the one of the first and second hydraulic arrangements, and a second switching state in which the third spray device is connected to the one of the first and second hydraulic arrangements; and determining with a control device a current switching state of the third spray device as a function of a difference between the pump current when washing liquor is supplied to the first hydraulic arrangement and when washing liquor is supplied to the second hydraulic arrangement by detecting a first pump current when the first hydraulic arrangement is supplied with washing liquor, detecting a second pump current when the second hydraulic arrangement is supplied with washing liquor, determining a delta value as a difference between the first pump current and the second pump current, and comparing the delta value with a predefined threshold value, with the delta value being greater than the threshold value in the first switching state of the third spray device and smaller than the threshold value in the second switching state of the third spray device.

* * * * *